United States Patent [19]

Kunig

[11] Patent Number: 4,532,678

[45] Date of Patent: Aug. 6, 1985

[54] NEEDLE BAR DRAWING DEVICE

[75] Inventor: Helmut Kunig, Bad Schwartau, Fed. Rep. of Germany

[73] Assignee: S.A. Des Ateliers, Houget Duesberg Bosson, Ensival, Belgium

[21] Appl. No.: 503,712

[22] Filed: Jun. 13, 1983

[30] Foreign Application Priority Data

Jun. 16, 1982 [DE] Fed. Rep. of Germany ..... 3222600

[51] Int. Cl.[3] ..... D01G 19/26; D01H 5/08

[52] U.S. Cl. ..... 19/129 R

[58] Field of Search ..... 19/129 R, 129

[56] References Cited

U.S. PATENT DOCUMENTS 4,070,732 1/1978 Herubel ..... 19/129 R 4,344,208 8/1982 Kunig ..... 19/129 R

FOREIGN PATENT DOCUMENTS 913272 4/1954 Fed. Rep. of Germany .... 19/129 R 2090880 7/1982 United Kingdom ..... 19/129 R

*Primary Examiner*—Louis K. Rimrodt

*Attorney, Agent, or Firm*—Edward F. Levy

[57] ABSTRACT

The invention concerns the gilling area of needle bar drawing devices (gill boxes) for card slivers which gilling area comprises needle bars provided with needles, carried by flexible driving elements and rotatingly driven. In a gilling area whose needle bars are carried by belts, especially toothed belts, as driving elements, it is suggested to arrange support elements for the needle bars to be clamped positively to the driving element.

9 Claims, 3 Drawing Figures

NEEDLE BAR DRAWING DEVICE

BACKGROUND OF THE INVENTION

1. Field of the Invention

The invention concerns a needle bar drawing device (gill box) for card slivers comprising a rotatingly driven gilling area of needle bars provided with needles, which bars are carried on both sides of the gilling area by means of flexible driving elements such as chains, belts or the like.

2. Description of Prior Art

Such needle bar drawing devices are known in the most varied embodiments.

Thus a device can be taken from German Patent Publication No. 913 272 in which the needle bars are mounted in a driving member formed as a chain, belt or steel belt.

The use of belts as a driving and carrying element for the needle bars overcomes some deficiencies which adhere to the normally used embodiments of needle bar drawing devices with needle bars carried by roller or inverted tooth type chains. Thus it is disadvantageous in the needle bars of the latter type that the synchronisation of the gilling areas dipping into each other can only be safeguarded if the elongation of the support chains caused by wearing appears evenly in all chains used in one aggregate, which synchronisation is necessary and essential especially in needle bar drawing devices which work with an upper and a lower field. The comparatively wear-free and non-extensible toothed belt suggested by the cited publication avoids this problem.

Furthermore a shortening of the "Nip" i.e. of the uncontrollable zone between the clamping line of the draw-off roller and the exit position of the needles from the card sliver can be achieved when using belts due to their smaller deflection radius compared to that of a chain.

However, a deficiency occurring in this embodiment lies in that the toothed belt which can only be manufactured to the necessary quality with the most modern technical know-how anyway, must be provided additionally with fittings and/or annexed parts necessary for mounting the needle bars which makes the manufacturing process of such a belt even more complicated and therefore more expensive. Furthermore it is necessary to form the bearings of the needle bars from a special bearing material since the belt material itself is not usually suitable for such stress.

3. Object of the Invention

It is therefore a main and essential object of the invention to suggest a driving and carrying resp. support element for the needle bars of a gill box which can be modified simply for the generic use using standard elements available in the trade.

SUMMARY OF THE INVENTION

This object is achieved according to the invention in that each driving element comprises a standard toothed belt which is provided with support elements on which the needle bars are mounted rotatably, each support element being formed to be clamped positively.

The advantages which go beyond those already inherent in the above object consist, among others, in the essentially simplified provision, supplying and mounting of replacement or spare parts.

In this connection it is also an advantage that each support element is so designed that it can be mounted in correct position with respect to the tooth comb of the toothed belt.

In order to achieve a sufficient dimension of the support elements which receive the needle bars it is advantageous if each support element has at least one bearing for receiving the needle bar, the largest width of each support element being larger than the pitch of the toothed belt, at least in the region of the bearings, and if the bearings of neighbouring support elements are provided in an offset arrangement with respect to each other.

The insertion of the needle bars can be easily carried out if the bearings in each support element are formed as support bearings opening outwards.

Expediently the support elements may be manufactured from a wear-resistant plastic material by injection moulding.

BRIEF DESCRIPTION OF THE DRAWINGS

Other and further objects of the present invention will be apparent from the following description and claims and are illustrated in the accompanying schematic drawings, which, by way of illustration, show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the drawings

DETAILED DESCRIPTION OF THE PREFERRED EMBODIMENT

Figure 1:
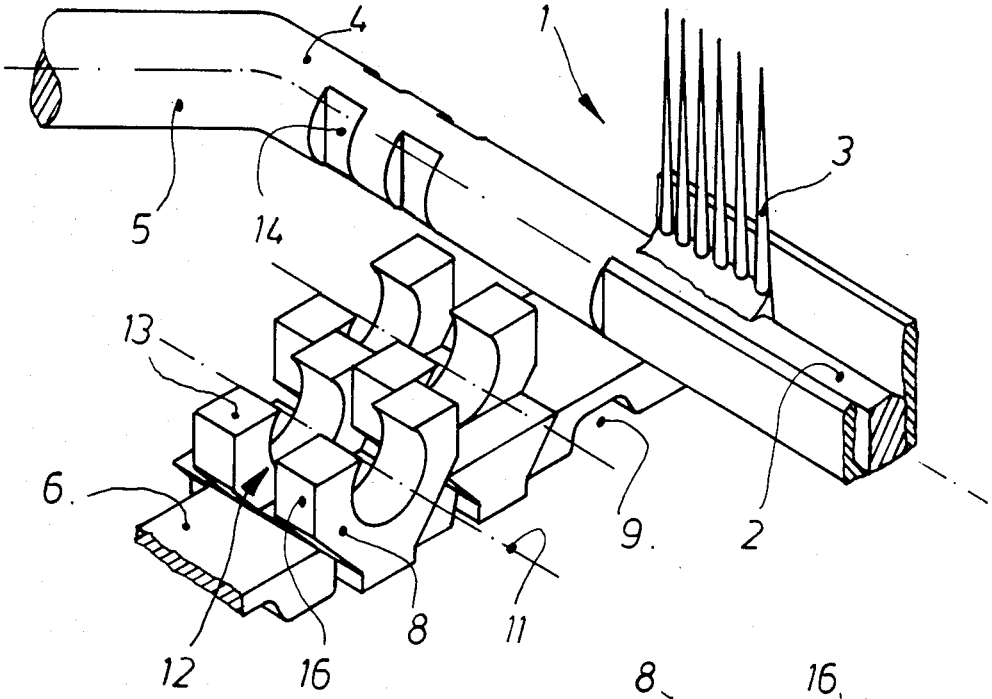
FIG. 1 shows a partial and sectional view of a driving element according to the invention in axonometrical representation.
Figure 2:
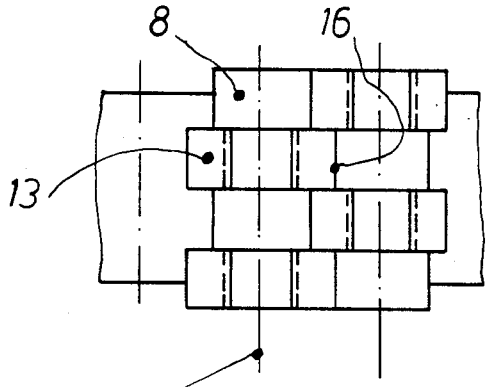
FIG. 2 shows a top view of the driving element.
Figure 3:
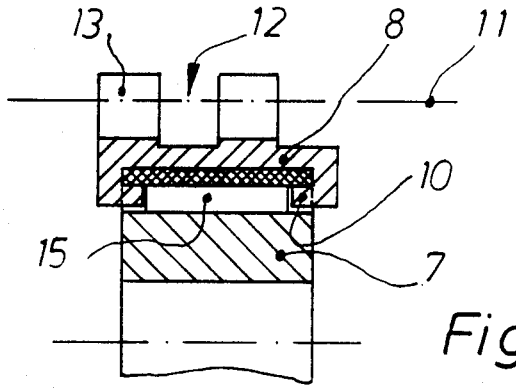
FIG. 3 shows a cross-section through the driving element along the axis of the bearing of a support element without needle bar.

A gilling area 1 represented partially sectionally in the drawings and arranged between not-shown draw-in and draw-off rollers is formed in a usual manner by needle bars 2 lying closely adjacent to each other, the needle bars 2 being driven to rotate endlessly in such a way that needles 3 secured to the needle bars 2 in a suitable manner penetrate a card sliver on a part of their way. The needle bars 2 are provided with bearing shafts 4 on both sides of the needles 3, one of the bearing shafts 4 passing into a crank 5 just partly indicated in FIG. 1. The crank 5 ends in a crank pin which is guided in a not-shown conduit or channel cam arranged fixedly on the not-shown framework so that the needles 3 can be conveyed into the working plane near the draw-in rollers in a vertical alignment and conveyed out in the corresponding position near the draw-off rollers. The conveying engagement on the needle bars 2 is performed by means of driving elements 6 arranged in the region of both bearing shafts 4 and formed as a toothed belt, the driving elements being driven to rotate endlessly about driving and reversing rollers 7 running in bearings in the not-shown machine frame. Supporting elements 8 manufactured by injection moulding from a wear-resistant plastic material e.g. acetal resin are provided to receive the bearing shafts 4. The supporting elements 8 have catches or dogs 10 which on their underside surround the driving element 6 in the region of tooth grooves 9. A bushing opening upwards is provided as a bearing for the bearing shafts 4 of the needle bars 2, the bushing being divided up into two support bearings 13 by recesses 12 running transverse to the bearing axis 11. The support bearings 13 have the same width as the recesses 12. The latter are arranged such that the total length of the support element 8 is divided into four identical sections, support bearings 13 and recesses 12 alternating with each other. The thus achieved dissymmetry in the arrangement of the support bearings 13 enables the reciprocal interlocking of neighbouring support elements 8, the width of which can thus exceed the pitch of the driving element 8. The bearing shafts 4 of the needle bars 2 are provided with flat portions 14 whose key width resp. basic dimension corresponds to the width of the upper opening of the support bearings 13 so that the needle bars 2 can be introduced from above into the support elements in a usual manner and brought into their working position by longitudinal displacement. In order to enable free movement of the catches 10 above the driving and reversing rollers 7 their tooth combs 15 have a correspondingly reduced width.

The width of the support elements 8 can be so chosen that the bearing shafts 4 of the needle bars 2 mounted therein are each supported in the working area of the gilling area 1 by outer shoulders 16 of the support bearings 13 of each neighbouring support element 8 which support bearings engage the recesses 12.

What is claimed is:

1. A needle bar drawing device (gill box) for card slivers, said device comprising rotatingly driven gilling area means defining two sides and including a plurality of needle bar means, each provided with needle means and carried on both said sides of said gilling area means by flexible driving means, wherein said driving means are designed as standard toothed belt means defining a tooth comb and a pitch and carrying support elements on which said needle bar means are mounted rotatably, each of said support elements being formed to be fixedly clamped to the respective one of said driving means.

2. A needle bar drawing device as claimed in claim 1, wherein each of said support elements is designed to be mounted in correct position in relation to said tooth comb.

3. A needle bar drawing device as claimed in claim 2, wherein each of said support elements is formed of a hard wearing plastic material manufactured by an injection moulding process.

4. A needle bar drawing device as claimed in claim 1 wherein each of said support elements includes mounting means for receiving one of said needle bar means, the largest width of each of said support elements at least in the area of said mounting means being greater than the pitch of said toothed belt means, said mounting means of neighboring ones of said support elements being provided in an offset arrangement with respect to each other.

5. A needle bar drawing device as claimed in claim 4, wherein said mounting means in each of said support elements are formed as support bearings open to the outside.

6. A needle bar drawing device as claimed in claim 4, wherein each of said support elements is formed of a hard wearing plastic material manufactured by an injection moulding process.

7. A needle bar drawing device as claimed in claim 1, wherein each of said support elements is formed of a hard wearing plastic material manufactured by an injection moulding process.

8. A needle bar drawing device (gill box) for card slivers, said device comprising rotatingly driven gilling area means defining two sides and including a plurality of needle bar means, each provided with needle means and carried on both said sides of said gilling area means by flexible driving means, wherein each of said driving means comprises a toothed belt having evenly spaced teeth separated by a grooves defining a flat body portion, each toothed belt carrying a plurality of support elements on which said needle bar means are mounted rotatably, each of said support elements being formed with a pair of spaced clamping members sized and positioned to be fixedly clamped to a respective toothed belt at said flat body portion between a respective pair of teeth.

9. A needle bar drawing device as claimed in claim 8, wherein each of said clamping members comprises an angular bracket at each end of said support element, sized and positioned to receive and clamp the edge of one of said flat body portions of said toothed belt.

* * * * *